US012263872B2

(12) United States Patent
Da Cruz et al.

(10) Patent No.: US 12,263,872 B2
(45) Date of Patent: Apr. 1, 2025

(54) TRACK-CHANGING DEVICE FOR A PNEUMATIC TRANSPORT VEHICLE

(71) Applicant: AEROM REPRESENTAÇÕES E PARTICIPAÇÕES LTDA., Porto Alegre (BR)

(72) Inventors: Diego Da Cruz, Porto Alegre (BR); Marcus Coester, Porto Alegre (BR); Oskar Coester, Porto Alegre (BR)

(73) Assignee: AEROM REPRESENTAÇÕES E PARTICIPAÇÕES LTDA., Porto Alegre (BR)

( * ) Notice: Subject to any disclaimer, the term of this patent is extended or adjusted under 35 U.S.C. 154(b) by 882 days.

(21) Appl. No.: 17/428,473

(22) PCT Filed: Feb. 11, 2020

(86) PCT No.: PCT/BR2020/050032
§ 371 (c)(1),
(2) Date: Aug. 4, 2021

(87) PCT Pub. No.: WO2020/163933
PCT Pub. Date: Aug. 20, 2020

(65) Prior Publication Data

US 2022/0119018 A1 Apr. 21, 2022

(30) Foreign Application Priority Data

Feb. 11, 2019 (BR) ..... 102019002764-9

(51) Int. Cl.
*B61J 3/08* (2006.01)
*B61B 13/12* (2006.01)
(Continued)

(52) U.S. Cl.
CPC ..... *B61J 3/08* (2013.01); *B61B 13/122* (2013.01); *E01B 7/00* (2013.01); *E01B 25/00* (2013.01); *B61B 5/00* (2013.01)

(58) Field of Classification Search
CPC . B61J 3/08; B61B 13/122; B61B 5/00; B61B 13/00; E01B 7/00; E01B 25/00;
(Continued)

(56) References Cited

U.S. PATENT DOCUMENTS 3,722,424 A 3/1973 Veldhuizen
4,774,891 A * 10/1988 Coester ..... E01B 25/00 104/155
(Continued)

FOREIGN PATENT DOCUMENTS

BR 8301706 A 11/1984
BR 8503504 A 9/1986
(Continued)

OTHER PUBLICATIONS

International Search Report in International Application No. PCT/BR2020/050032, Mailed Apr. 30, 2020.

*Primary Examiner* — Zachary L Kuhfuss
*Assistant Examiner* — Heaven R Buffington
(74) *Attorney, Agent, or Firm* — Berg Hill Greenleaf Ruscitti LLP

(57) ABSTRACT

The present invention refers to an improvement developed on a pneumatic transport system for loads and/or passengers whose vehicles are not provided with on-board drive means, being guided on two exclusive tracks arranged in parallel. The vehicles travel over railway tracks laid over an elevated track supported by pillars. The center of the top of the superstructure of the elevated track has a longitudinal slot with seal by means of which the mast of the propulsion plate is allowed to move freely along the path of the vehicle. In
(Continued)

the superstructure of the turnout beams there are mounted the mobile rails with their respective drive mechanisms and locking. A section isolation valve is positioned inside the propulsion duct of the turnout beams.

7 Claims, 14 Drawing Sheets

(51) Int. Cl.
*E01B 7/00* (2006.01)
*E01B 25/00* (2006.01)
*B61B 5/00* (2006.01)

(58) Field of Classification Search
CPC ..... E01B 7/02; E01B 7/04; E01B 7/06; E01B 7/10; E01B 7/12; E01B 7/14; E01B 7/18; E01B 7/20
USPC ..... 104/130.03, 155, 156
See application file for complete search history.

(56) References Cited

U.S. PATENT DOCUMENTS 5,845,582 A * 12/1998 Coester ..... B61B 13/122 104/156
6,076,469 A * 6/2000 Coester ..... B61B 13/122 104/138.1

FOREIGN PATENT DOCUMENTS

| | | | | |
|---|---|---|---|---|
| BR | PI0901119 | A2 | | 5/2012 |
| BR | 102014014409 | A2 | * | 4/2016 |
| EP | 1628867 | A2 | | 3/2006 |
| KR | 20030062094 | A | * | 9/2004 |
| RU | 2693388 | C2 | | 7/2019 |

* cited by examiner

TRACK-CHANGING DEVICE FOR A PNEUMATIC TRANSPORT VEHICLE

CROSS REFERENCE TO RELATED APPLICATION

This application is a national stage application under 35 U.S.C. 371 of PCT Application No. PCT/BR2020/050032 having an international filing date of Feb. 11, 2020, which designated the United States, which PCT application claimed the benefit of Brazilian application Ser. No. 102019002764-9, filed Feb. 11, 2019, both of which are incorporated by reference in their entirety.

TECHNICAL FIELD

The present invention refers to an improvement developed on a pneumatic transport system for loads and/or passengers whose vehicles are not provided with on-board drive means, being guided on two exclusive tracks arranged in parallel, each track being dedicated to one travel direction, resulting in high transport capacity.

More specifically, the invention consists of a diagonal track, commonly known as crossover, which connects the two referred parallel tracks, as well as to the track-changing device installed in both ends, allowing transposing a vehicle from one line to the other. A pivoting valve is comprised for the physical separation of the pneumatic propulsion circuits of the vehicles, the section isolating valves, applied both in the crossbeams as in strategic points throughout the entire track, allowing the concomitant and independent operation of multiple vehicles.

BACKGROUND OF THE INVENTION

The change in track consists in an arrangement on the rails that enables changing the direction of the train in a bifurcation. In the conventional rail system, this change in track is executed by the Track Switching Apparatus—AMV and can consist of two types: manual, which are activated by a lever, and the electric, which are activated by a switch machine. When the AMV is activated to execute the change in track a part known as a rod transmits the lever or switch machine movement to the gate, which consists of a tapered mobile part to adapt to the back rail or gate. These gates have articulation points and move simultaneously in the direction required by the lever or the switch machine causing the change in track.

A pneumatic propulsion vehicle has a mast for sustaining a plate which fills the interior of the section of the duct through which there is airflow. For this, the top of the duct presents a longitudinal slot located between the rails, through which the mast of the propulsion plate passes. The conventional AMVs are not suitable for the rails positioned over the pneumatic propulsion ducts, since they use an interconnecting rod of the tracks, which obstructs the passage of the mast of the actuator plate of the pneumatic vehicle.

Patent documents PI 7703372-8, PI 7906255-5, PI 8301706-2, PI 8503504-1, PI 9502056-0, PI 9814160-0, PI 9912112-3, PI 0805188-7 and PI 0901119-6 describe a pneumatic transport system which is comprised of light vehicles comprising, preferably, bogies containing four metallic wheels each, being at least one of the shafts connected to a mast screwed to a propulsion plate, which is responsible for the conversion of the thrust of the fluid in mechanical work for movement of the vehicles over railways laid over a special elevated track.

Mounted over vertical pillars, the elevated track, apart from the function of sustaining and direction of the vehicles, is further characterized by consisting in the propulsion duct thereof, device in charge of the creation of the physical means for contention and propagation of the air flow generated by stationary power-unit groups. Integrated by a heavy duty industrial fan and a set of valves, the power-unit groups are responsible for elevating or reducing the manometric pressure in the hollow interior of the beams which form the elevated track.

In the center of the upper slab of the superstructure of the elevated track there is a longitudinal slot which characterizes the resistant section as being of the open box type, through which slot the mast of the propulsion plate is able to move freely along the path of the vehicle.

According to patent PI9814160-0, this slot can be sealed by the physical positioning of the two pairs of sealing flaps formed by highly resistant and durable material, excellent mechanical memory and low surface friction.

In patents PI 8301706-2 and PI 8503504-1 there are presented alternatives to mechanical arrangements for the section isolation valves, which function is to allow the simultaneous and independent operation of multiple vehicles throughout the track. They are conveniently used to compartimentalize a propulsion circuit relating to another adjacent one by the physical interruption of the propulsion duct and consequent blocking of the airflow in the interior of the tracks.

Still in patent PI 8503504-1 there is presented a constructive model of a track changing apparatus for a pneumatic transport system having low capacity and small daily circulation, being comprised of fixed and mobile rails. The mobile rails are the elements to be commuted, whereby each track changing means comprises two gates, being one pair coupled to the intermediary mobile rails and a mobile frog The fixed rails can be back rail or connecting. The first type makes the lateral laying of the mobile rails, while the second makes the connection with these. There is described a torque tube system connected to a linear actuator to carry out the change in track under the elevated track, working simultaneously on the articulation points of the tracks. This system requires an installation below the referred track which is interconnected with all the articulation points of the tracks to carry out this change, which makes the installation complex and hampers the maintenance of the system.

Patent document BR 10 2014 014409 9 presents an improvement over the prior arrangement. It is disclosed that over the propulsion duct table where the fixed and mobile tracks are laid there are further anchored the respective drive sets by means of pre-existing inserts on the concrete surface. These sets are formed by cams eliminating the inconvenient torque tubes system for actuation. There is further introduced a locking system for the mobile tracks.

However, these last two documents do not foresee a mechanical disposition for lane changing equipment in pairs to make up crossbeams, which are essential equipment for two-way applications with high passenger demand, nor is it foreseen the sealing shape of the propulsion duct in this region, which demands a differentiated treatment.

SUMMARY OF THE INVENTION

It is an objective of the present invention the improvement developed in a track changing device for vehicle for a system of pneumatic transport of passengers and/or loads with high capacity which presents the following technical characteristics:

- Diagonal rail (crossbeam) which connects two parallel rails, allowing the vehicle to transpose and change track, comprising an internal pneumatic propulsion duct and supporting pillars;
- Mobile rails arranged over the diagonal rail stand which are comprised of gates, intermediary rails and frogs.
- Drive and safety locking mechanisms of the mobile rails which are of the safefail type and comprise linear actuators, rods and stops, whereby the locking mechanisms have identical mechanical configuration for all types of mobile rails;
- Section isolation valve which is positioned inside the propulsion duct of the vehicle in the diagonal track;
- Mechanical sealing complement for the propulsion duct in the bifurcation region of the diagonal track, allowing the operation under higher air pressure levels;
- Sealing terminal for the propulsion duct slot in the diagonal track during the displacement of the mast of the propulsion plate of the vehicle.

ADVANTAGES OF THE INVENTION

The improvement in a track-changing device for a pneumatic transport system of the invention results in the following advantages as regards the state of the art:

- It is applicable in two-way transport systems which demand very high-level performance, availability and safety of the equipment when in use under a large circulation operational regime;
- The crossbeam and the section isolation valve are standardized for any application in a pneumatic transport system, meeting particularly those with high availability requirements and high daily circulation;
- The crossbeam allows the crossing between lines in two-way line systems, particularly for return in the contrary direction in the end of journey terminals;
- The set of beams which makes up the crossbeam is designed in a manner to facilitate the construction process;
- The drive mechanism (switch stand) of the crossbeam is of the safefail type, whereby any contrary effort inciding on the mobile track is unloaded over a stop and not over the actuation cylinder, maintaining the set stable facing an external action, independent of the redundant locking system;
- The drive mechanism of the mobile tracks further enables the fine adjustment of the proximity of the mobile track with the fixed track, which facilitates the assembly of the sets and, particularly, aims at eliminating gaps that are eventually introduced after prolonged use;
- The drive mechanism of the intermediary mobile rails waives the use of the interconnection rod, which is difficult to regulate;
- The crossbeam is further comprised by a locking system which acts directly on the mobile rails and no longer on the drive system, increasing the safety level of the operation;
- The locking mechanism presents an identical mechanical configuration for all types of mobile rails, locking them both in the normal position (straight or in tangent), as in the reverse one (turnout or curve), whereby the support base of the locking system accumulates the complementary function of limit stop at the end of the path redundant for the intermediary and frog tracks;
- Comprises a sealing terminal for the duct slot for use in the bifurcation of the diagonal tracks which guarantees an excellent tightness, which is essential for the dynamic and energetic performance of the pneumatic transport system;
- The sealing terminal of the duct slot in the turnout favors a quick and easy installation, with minimum need of maintenance;
- The crossbeam is equipped with section isolation valve in the central position which prevents the circulation of air between the two tracks when the crossbeam is aligned for a tangent passage;
- Conversion of the section isolation valve in a safefail device, guaranteeing the immobilization in the closed position, avoiding the unintentional opening of the redundant locking system by means of the sealing pin;
- Metallic closure complement of the propulsion duct in the bifurcation region in the diagonal track, allowing the operation under higher air pressure levels, increasing the construction speed and reducing the manufacturing costs of the parts;

Section isolation valve with configuration which reduces significantly the visual impact on the lower back of the elevated track due to the reduction in the volume occupied by the drive mechanism thereof.

BRIEF DESCRIPTION OF THE DRAWINGS

The improvement in track changing device for pneumatic transport system of the present invention will now be described in detail based on the attached figures, listed below:

FIG. 23—Upper schematic view of the crossbeam indicating the section isolation valve.

FIG. 1 illustrates the two-way pneumatic propulsion system of the state of the art which consists of vehicles (1), preferably comprising two or more bogies, each one comprised of four metallic wheels (2), whereby one of the shafts is connected to a mast (3) fixed to a propulsion plate (4) which is the one responsible for the conversion of the fluid thrust of the compressed air current in mechanical work. The vehicles (1) travel over railway tracks (5) laid over elevated tracks supported by pillars (7). In the center of the top of the elevated track superstructure (6) there is a longitudinal slot (9) and respective sealing by means of which the free movement of the mast (3) is allowed from the propulsion plate (4) of the vehicle (1) along the path.

FIGS. 2 and 3 detail the general aspect of the state of the art of the seal (8) of the longitudinal slot (9). The seal (8) consists of two profiles placed one in front of the other, each one fixed by a set of screws and metallic pressure bars (10), anchored to the elevated track (6) by means of pre-existing inserts (11). When the vehicle travels over the elevated track (6) the tabs of the seal profile (8) move away generating space for the displacement of the mast (3) of the vehicle propulsion plate, as illustrated in FIG. 2. FIG. 3 illustrates the tabs of the seal profile (8) in the rest position.

FIG. 4 illustrates the set formed by the crossbeam over the tracks (5) in tangent route, being sustained by pillars (7), with a central pillar having a transverse conceived to support the double head of each one of the two turnout beams in the position where the bifurcation of the propulsion duct (12) occurs in two distinct ducts. The crossbeam region is comprised by four beams which constitute the superstructure of the elevated track, being two turnout beams (6') and two straight beams (6"). The four beams (6 and 6') are permanently connected to each other and to the pillars (7) in the region of the heads in order to form a monolithic hyperstatic structured in the form of a portico.

FIG. 5 divides the structures of the crossbeam according to the material which they consist of, while at the same time it identifies the specific sealing position of the turnout. The turnout beams (6') have a lower slab, lateral walls and part of the upper slab constructed in concrete, which comprises a complementary metallic part (13) connected in balance, to allow the unobstructed passage of the vehicle propulsion plate inside the propulsion duct during the change of track maneuver. The complementary metallic part (13) is projected to have minimum vertical displacement during the intermittent pressurizing and depressurizing cycles of the duct in normal working conditions. A sealing terminal (14) of the longitudinal slot (9) of the bifurcation of the turnout beam (6') is executed in flexible material and fixed at the end of the complementary metallic part (13), in the opposite direction to the bifurcation of the track. The sealing terminal (14) enables the derivation from a single seal of the slot (9) of the straight beam (6") to a second sealing that is necessary for the suitable tightness of the propulsion duct of the turnout beam (6').

FIG. 6 details the transition of the sealing of the slot in the duct from the straight to the turnout and is divided in seven distinct representations (A to G), showing the transverse section of the terminal (14) in distinct points of interest where a significant change in geometry takes place, starting from the known set of two profiles (8) in the cut represented in (A), until it transforms into two sets united to each other (G). The terminal (14) is in one piece, which proximal end presents only two "V" shaped profiles laid down which are opposite and separated (14*a*). The intermediary portion of the terminal (14) has a vertical membrane (14*b*) which begins the bifurcation of the sealing tabs of each one of the slots of the turnout. The distal end of the terminal (14) has a horizontal membrane (14*c*) which interconnects the two pairs of sealing tabs for the two turnout slots. In its distal end there continues the common shape of the seal profile (8) by means of the in loco seam.

FIGS. 7 and 8 illustrate the set of the crossbeam in their normal position and in turnout, respectively, being emphasized the alignment of the tracks of the route of the vehicle (RV and RV') in both situations.

FIGS. 9, 10, 11 and 12 emphasize the positioning of the mobile rails (16, 18 and 21), and show the drive mechanisms (17, 19 and 20), and locking (15) associated thereto, as indicated in rectangles A and B of FIG. 7 and in rectangles C and D of FIG. 8, in this order.

Figure 1:
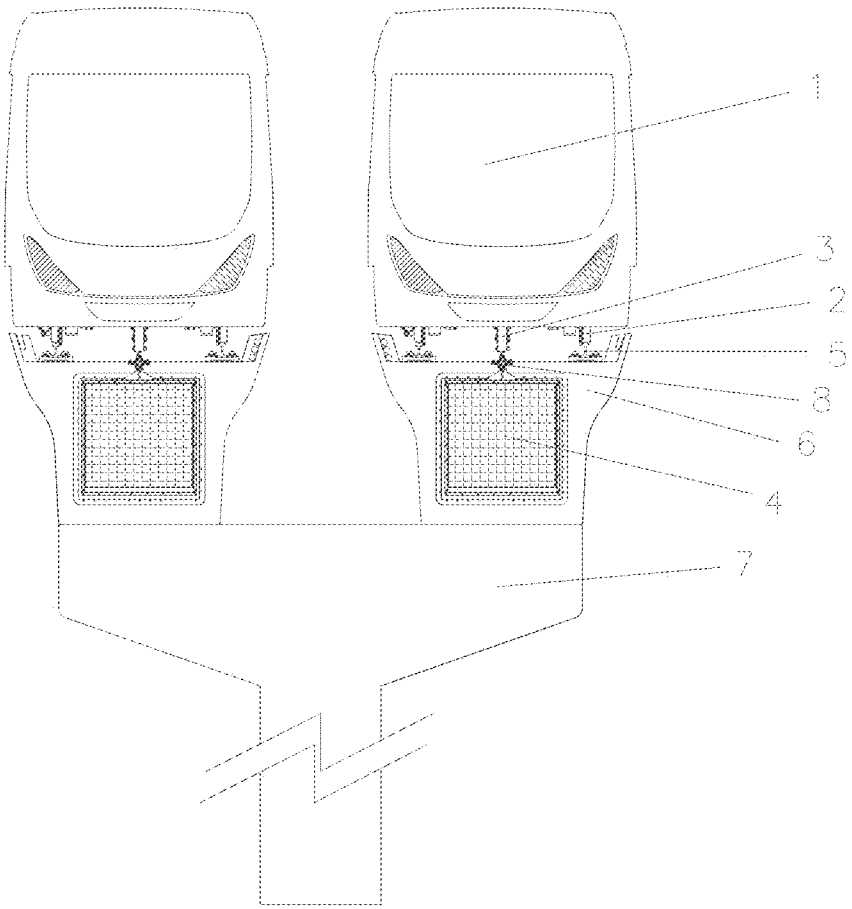
FIG. 1—front view of the pneumatic transport vehicle over the double elevated track of the state of the art.
Figure 3:
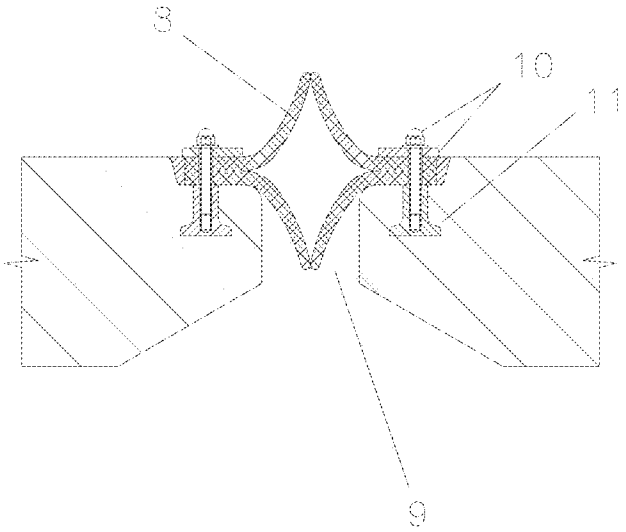
FIG. 3—front view of the closed sealing of the longitudinal slot of the propulsion ducts of the elevated track of the state of the art.
Figure 2:
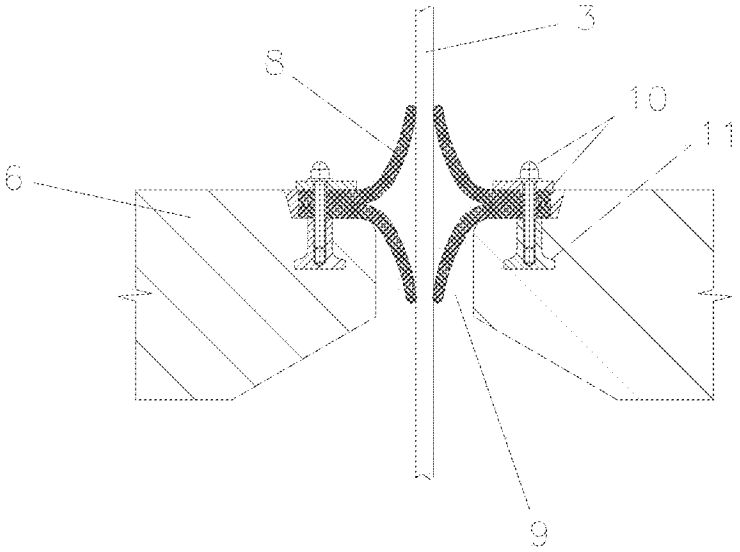
FIG. 2—front view of the sealing of the longitudinal slot of the propulsion duct of the elevated track during the passage of the mast of the plate of the vehicle of the state of the art.
Figure 4:
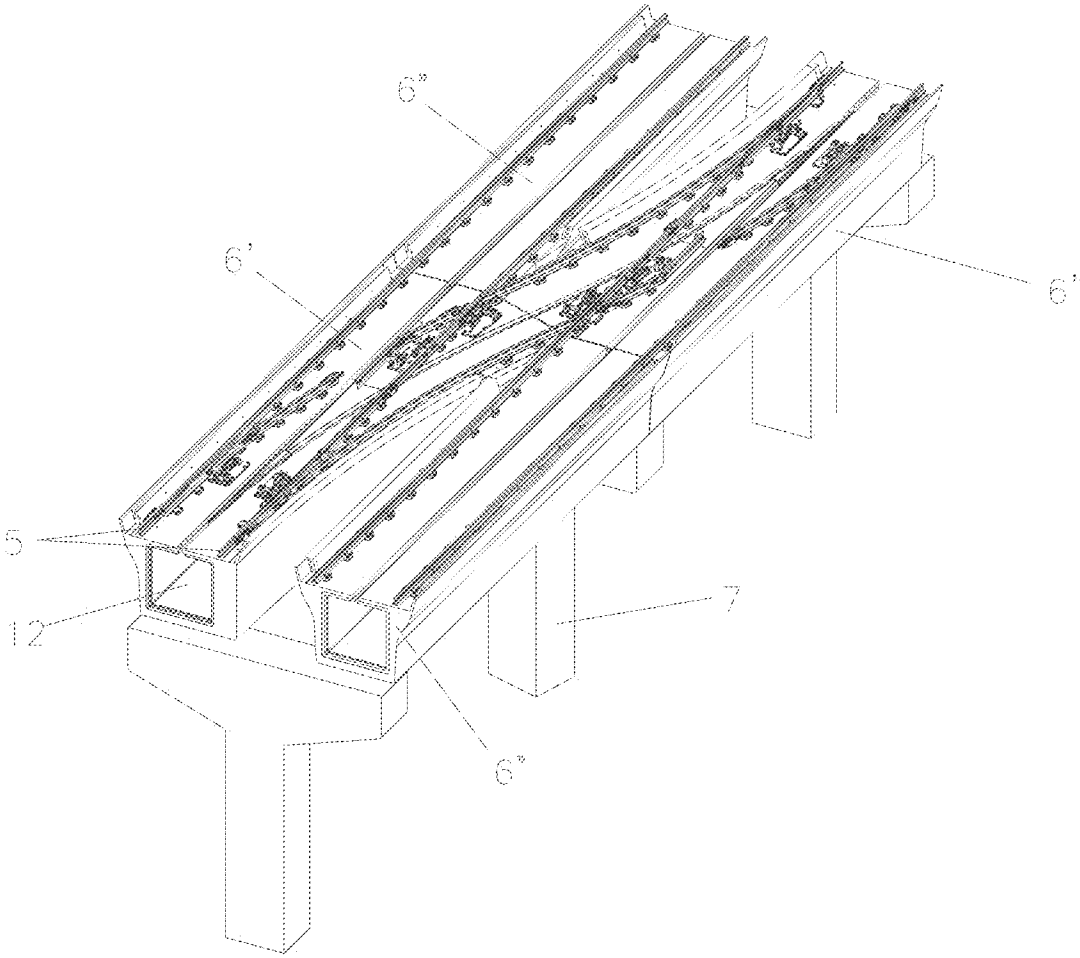
FIG. 4—perspective of the crossbeam set of the invention in normal position.
Figure 5:
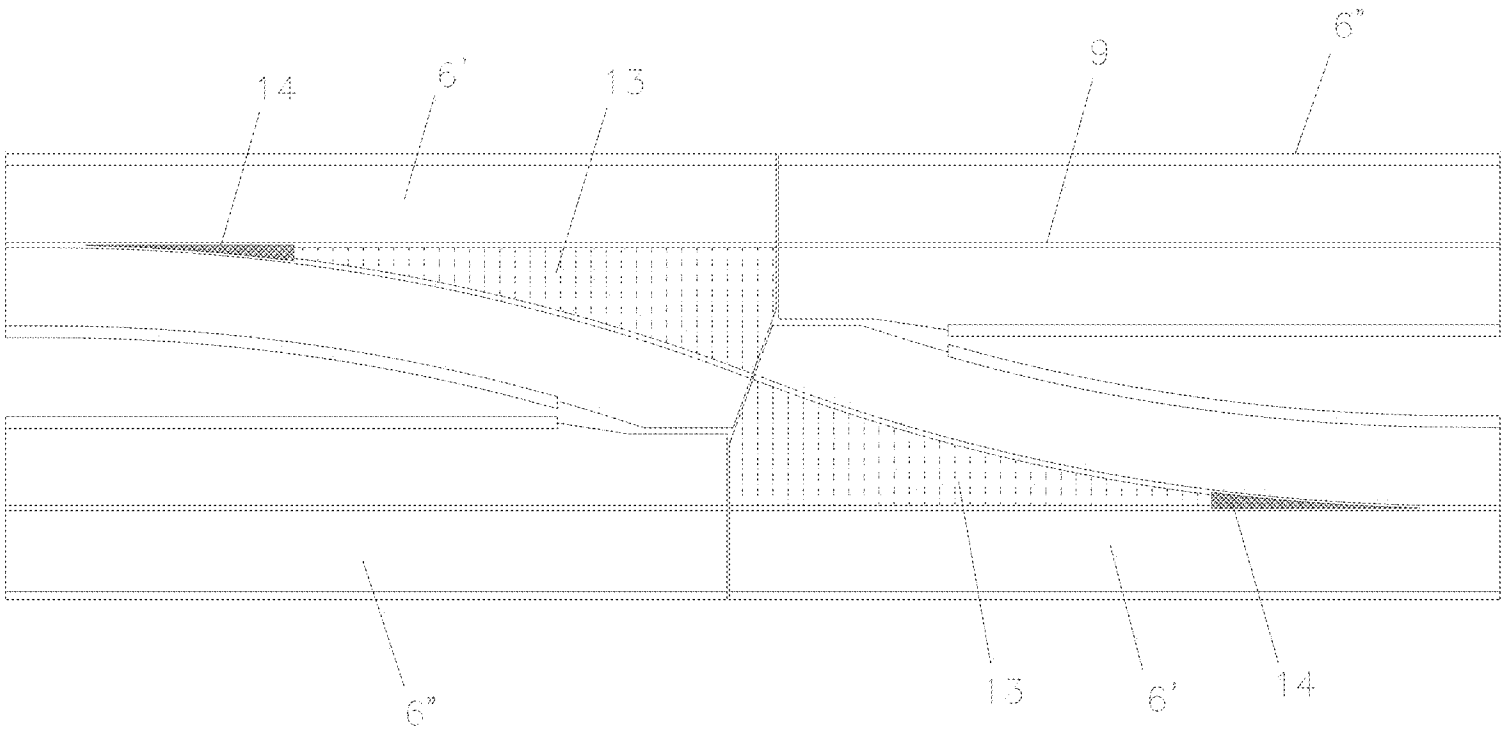
FIG. 5—schematic upper view of the crossbeam of the invention.
Figure 6:
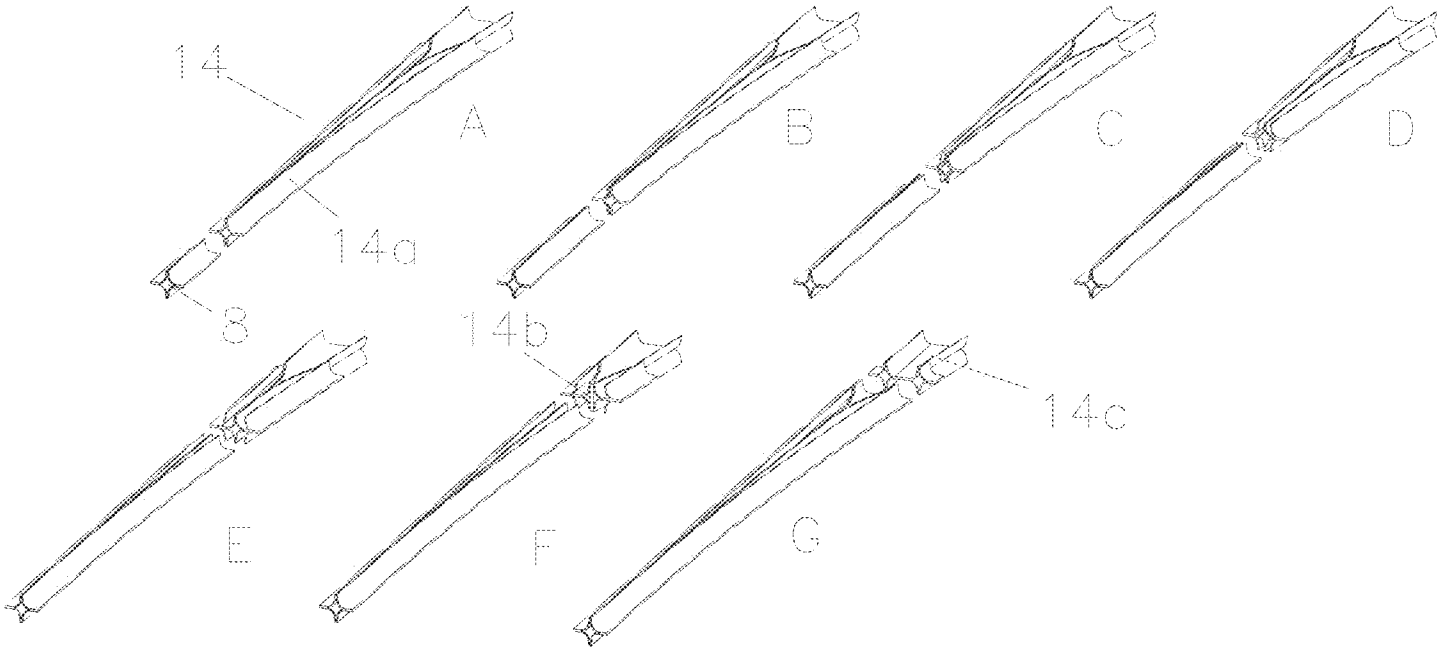
FIG. 6—sectioned perspectives of the sealing terminal of the longitudinal slot of the propulsion duct of the turnout beam.
Figure 7:
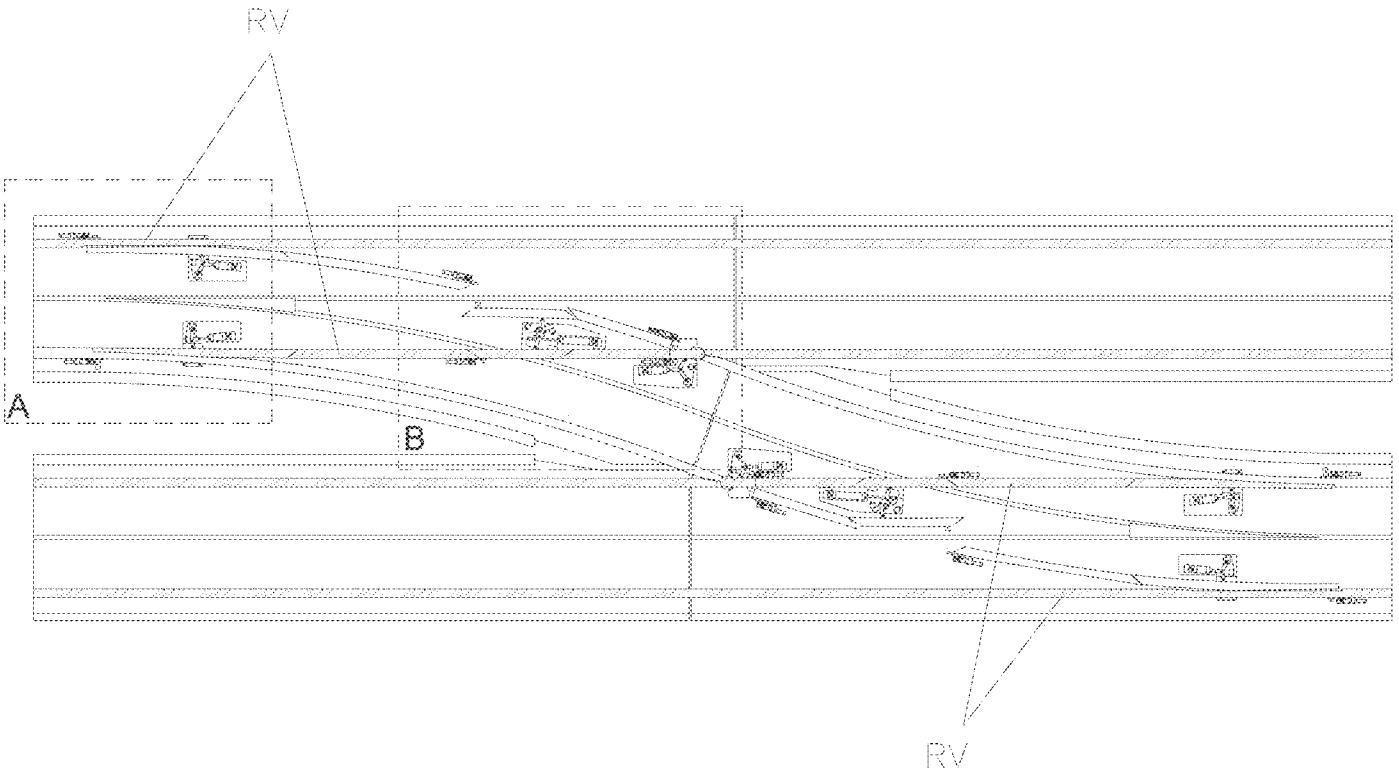
FIG. 7—upper view of the complete crossbeam in normal position.
Figure 8:
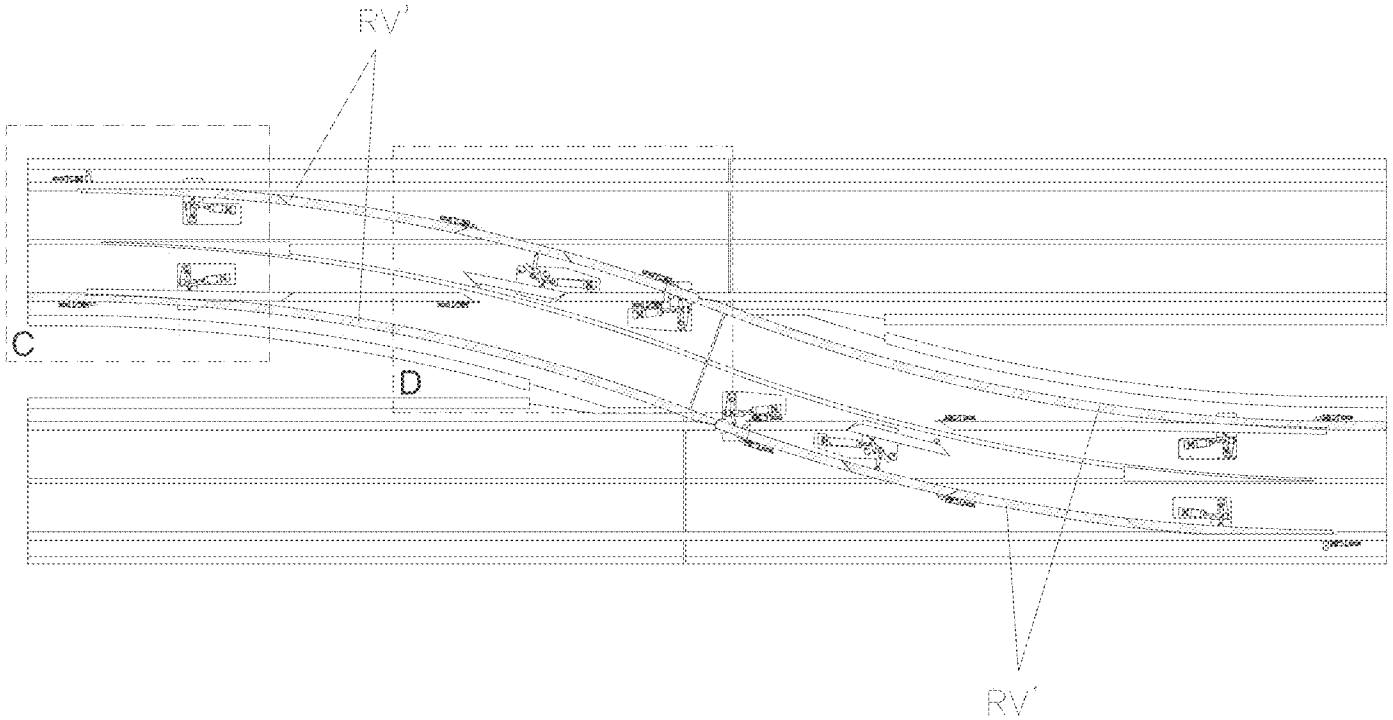
FIG. 8—upper view of the complete crossbeam in turnout position.

There are two types of mechanisms that make up the drive mechanisms (17, 19 and 20) of the mobile rails (16, 18 and 21) installed on the surface of the turnout beams (6'). The first mechanism is comprised by a pivoting rail to be moved individually, as occurs with the gates (16) and the frogs (21). The second mechanism is comprised of two rails directly connected, without a connecting rod between them, being the sole case of the intermediary rails (18).

For safety criteria, the position of the mobile rails (16, 18 and 21) is monitored by redundant sensors that are positioned on the surface of the turnout beams (6') next to the rails themselves, therefore not being an integral part of the drive mechanisms (17, 19 and 20).

Figure 10:
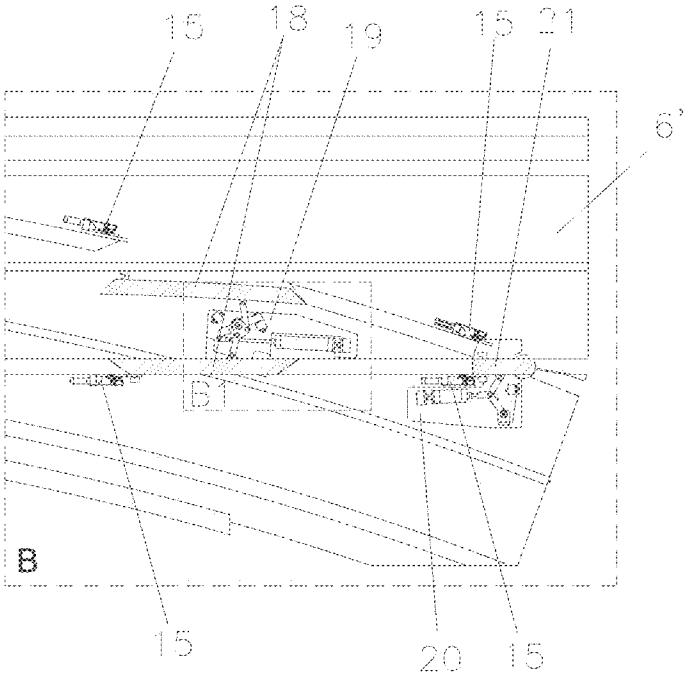
FIG. 10—Enlarged detail of rectangle B indicated in FIG. 7
Figure 9:
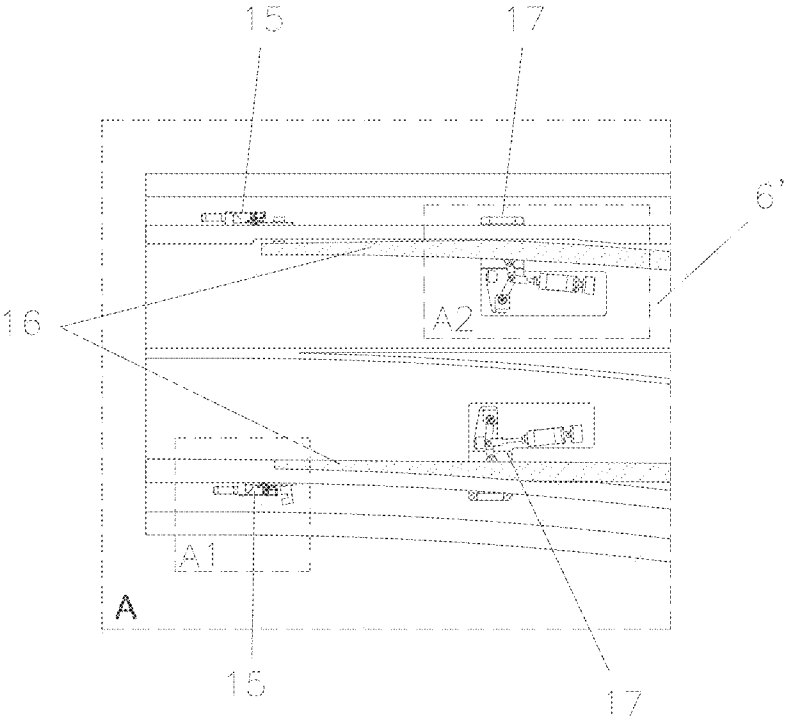
FIG. 9—Enlarged detail of rectangle A indicated in FIG. 7.
Figure 12:
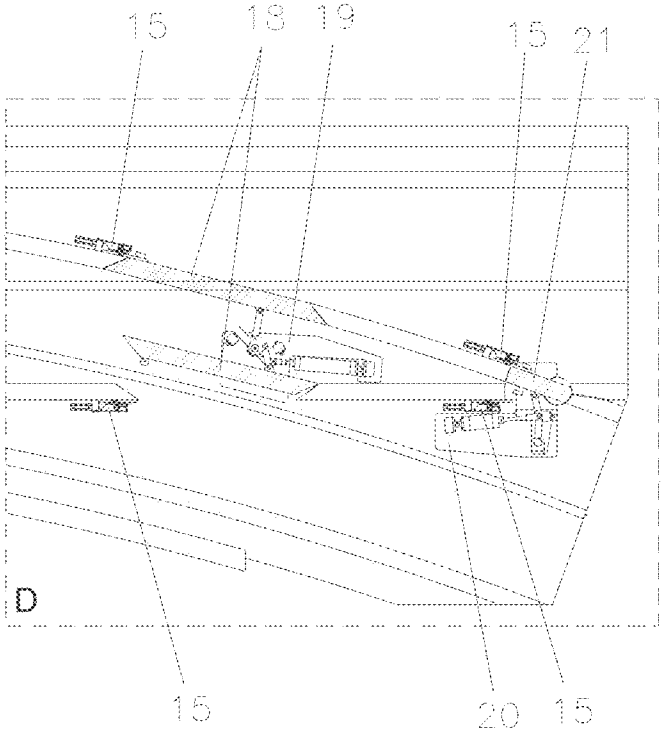
FIG. 12—Enlarged detail of rectangle D indicated in FIG. 8.
Figure 11:
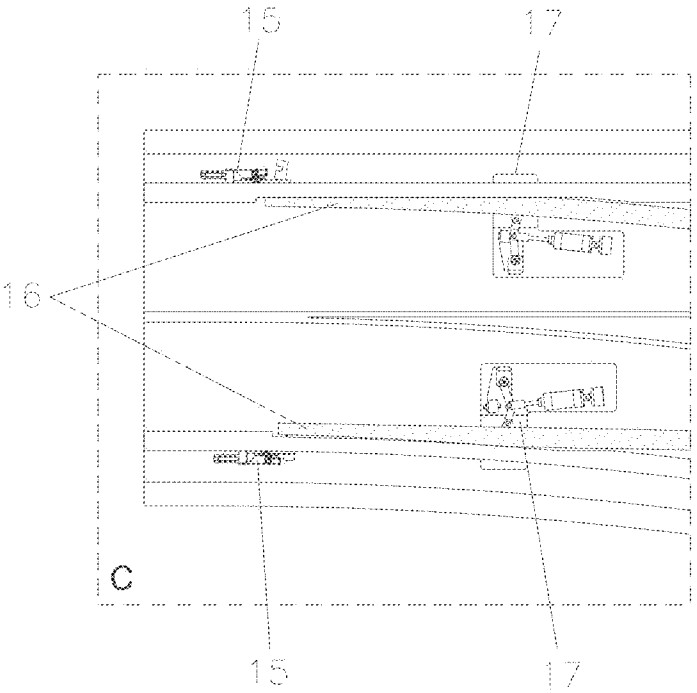
FIG. 11—Enlarged detail of rectangle C indicated in FIG. 8.
Figure 13:
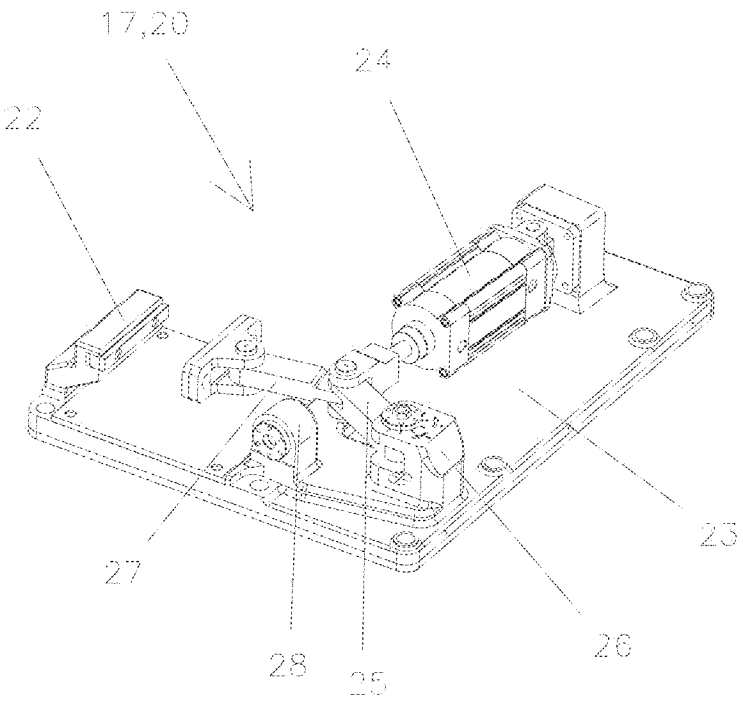
FIG. 13—Perspective of the drive mechanism of the segments on the mobile rails, as per sub-rectangle A2 indicated in FIG. 9.
Figure 14:
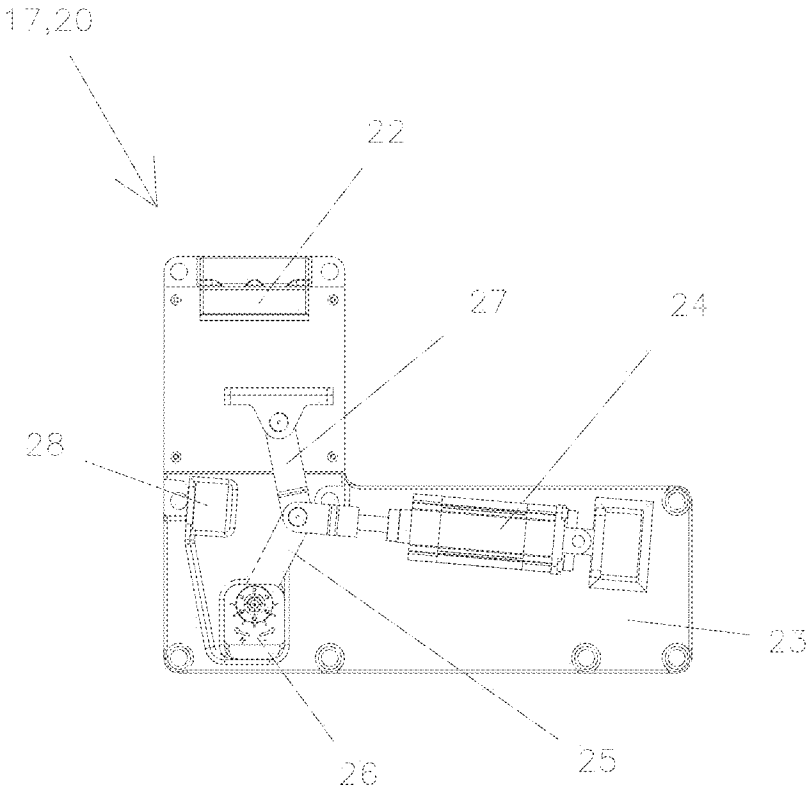
FIG. 14—Upper view of the drive mechanism of the segments of the mobile tracks as per sub-rectangle A2 indicated in FIG. 9.
Figure 15:
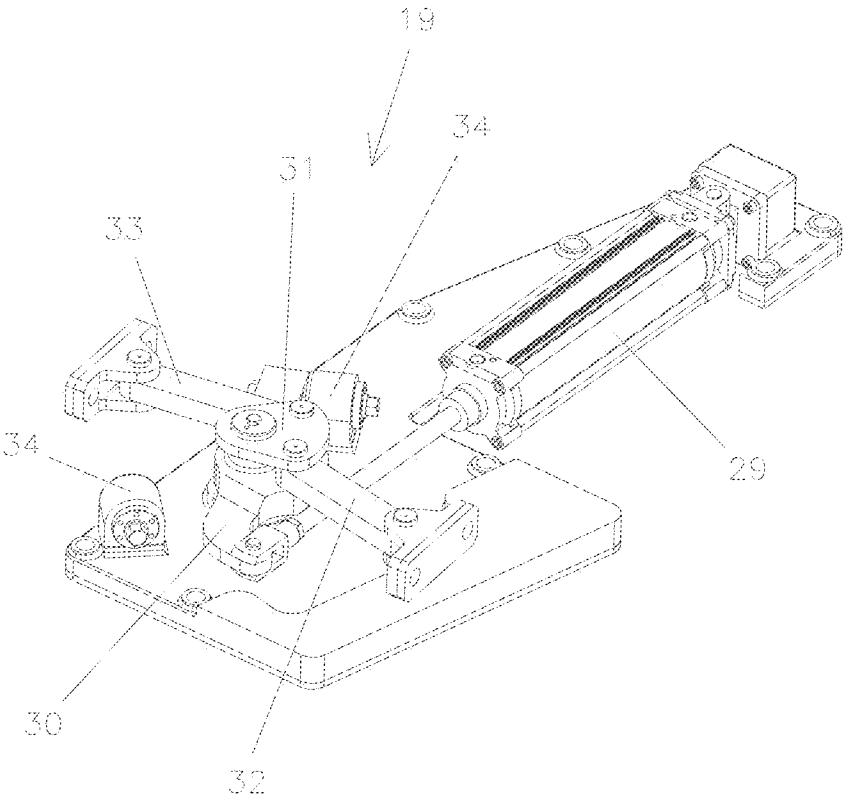
FIG. 15—Perspective of the drive mechanism of the intermediary tracks as per sub-rectangle B1 indicated in FIG. 10.
Figure 16:
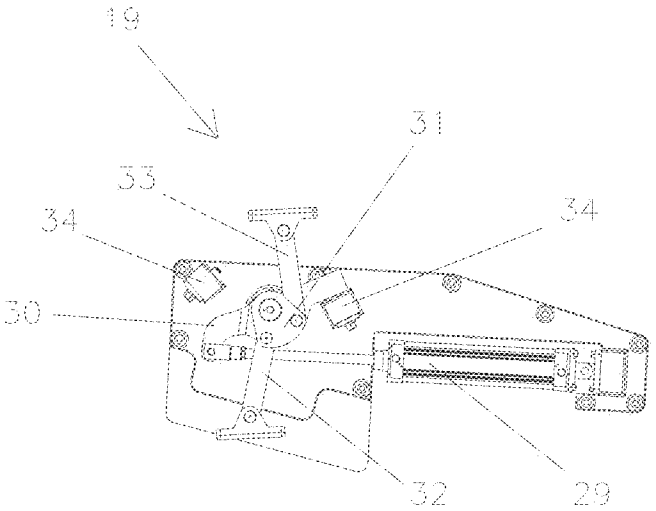
FIG. 16—Upper view of the drive mechanism of the intermediary tracks as per sub-rectangle B1 indicated in FIG. 10.
Figure 17:
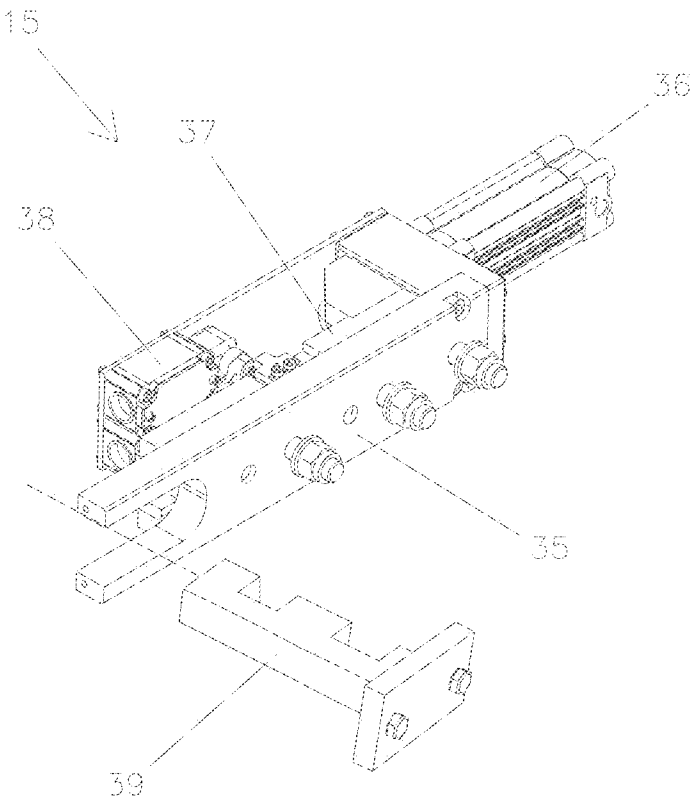
FIG. 17—Perspective of the locking mechanism of the mobile rails of sub-rectangle A1 indicated in FIG. 9.
Figure 18:
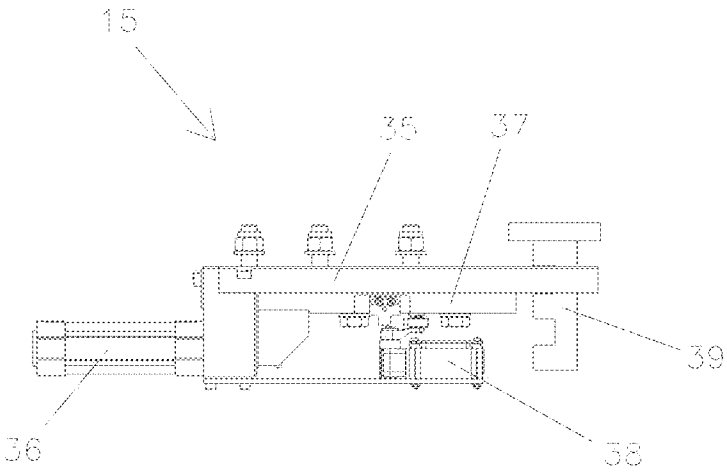
FIG. 18—Upper view of the locking mechanism of the mobile rails as per sub-rectangle A1 indicated in FIG. 9.

FIGS. 13 and 14 illustrate by themselves the drive mechanism (17) of the gates (16), as per the marking of the sub-rectangle A2 of FIG. 9. FIGS. 15 and 16 illustrate by themselves the drive mechanism (19) of the intermediary tracks (18), as per the marking on sub-rectangle B1 of FIG. 10. FIGS. 17 and 18 illustrate the locking mechanism (15) of the mobile rails (16, 18 and 21), as per the marking of sub-rectangle A1 of FIG. 9.

The gates (16) and the frog (21) have similar drive mechanisms (17 and 20). Differently from the frog (21), however, the drive mechanisms (17) of the gates (16) have an additional anchorage (22) in their respective back rail (counter-gate), apart from the one existing on the surface of the turnout beam (6').

The angular movement of the gates (16) is possible by means of the introduction of a hinge type flexible splint between them and the connection rail. In counterpart, the frog (21) moves by means of an internal pin located in one of its extremities.

According to FIGS. 13 and 14, the drive mechanisms (17 and 20) are comprised of a single base plate (23) over which rests a linear actuator (24), preferably pneumatic, which dislodges two articulation bars in their central point, being one primary articulation bar (25) connected to a route regulator (26) and the other articulation secondary bar (27) screwed directly on the mobile rail (16 or 21—not illustrated) for the conduction thereof. The regulation is carried out by means of the fine adjustment of an eccentric axis which is locked by a flange with a screw. The complete device has its movement limited by a stop limit (28) in the shape of a support pin, with identical regulation to the former.

Obligatorily, at the moment when the rod of the linear actuator (24) is totally extended against the stop (28) and, consequently, the mobile rail (16 or 21—not illustrated) is perfectly parallel with the respective fixed rail (5—not illustrated), the maintenance of this position must be guaranteed by the existence of an obtuse angle measured between the primary (25) and secondary (27) articulation bars on the opposite site of the drive mechanism (24) thus preventing that an external force applied directly to the mobile rail (16 or 21—not illustrated) result in the undesired displacement thereof.

According to FIGS. 15 and 16, the two intermediary mobile rails (18) have a drive mechanism (19) which is similar in concept to the gates (16) and the mobile frog (21), however, adapted for the simultaneous drive in two rail segments. The linear actuator (29) activates a lever (30) turning consequently an eccentric (31) which, in turn, moves simultaneously both the articulation bar (32) connected to the mobile rail (18—not illustrated) to be aligned for the tangent passage, as the articulation bar (33) connected to the mobile rail (18—not illustrated) to be aligned for reverse passage. The drive mechanism (19) has two limit stops (34) to, equally, ensure the maintenance of the position of the respective alignment, whereby the support is provided against one of the faces of the extremity that is opposite to that of the lever (30).

Apart from the immobilization of the tracks by means of the stops (28 and 34), the redundant position locking mechanism (15) of each mobile rail (16, 18 and 21) foresees the unauthorized movement of same when facing an improbable spurious command from the automatic control system for working of the respective actuator (24 and 29) of the drive system (17, 19, and 20).

According to FIGS. 17 and 18, the locking mechanism is identical for all the mobile rails (16, 18 and 21—not illustrated). It consists of a support base (35) screwed to the fixed track and wherein there are fixed a linear actuator (36), preferably pneumatic, the sliding lock (37) and the position sensors (38). The lock fitting (39) is screwed to the mobile rail (16, 18 and 21—not illustrated), and may have one or two recesses. The support base (35) further accumulates the supplementary function of stop limit for the intermediary rails (18) and frog (21).

Figure 21:
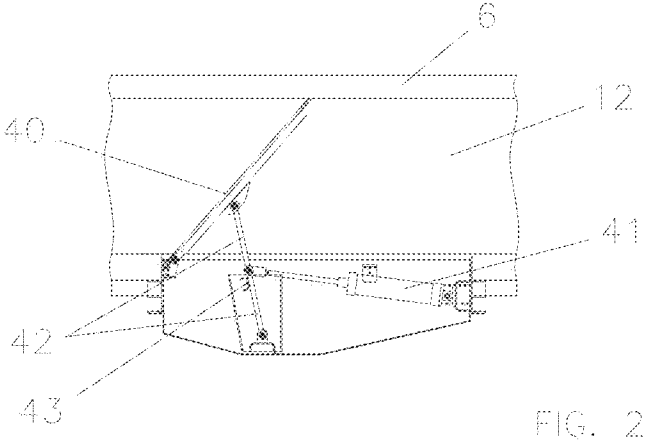
FIG. 21—Cut of the section isolation valve in the closed position, according to line AA indicated in FIG. 23.
Figure 22:
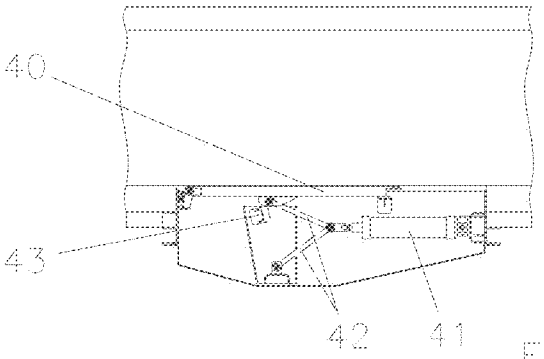
FIG. 22—AA cut of the section isolation valve in the open position.
Figure 19:
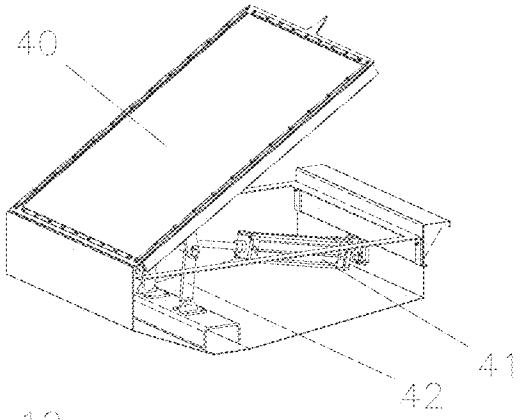
FIG. 19—Perspective of the section isolation valve in the closed position.
Figure 20:
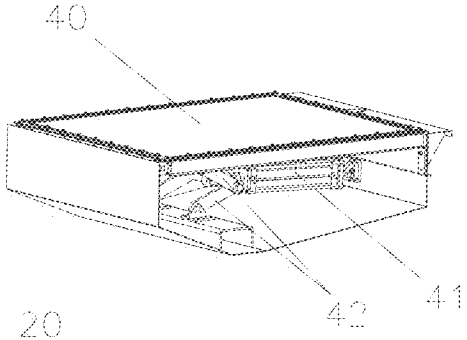
FIG. 20—Perspective of the section isolation valve in the open position.
Figure 25:
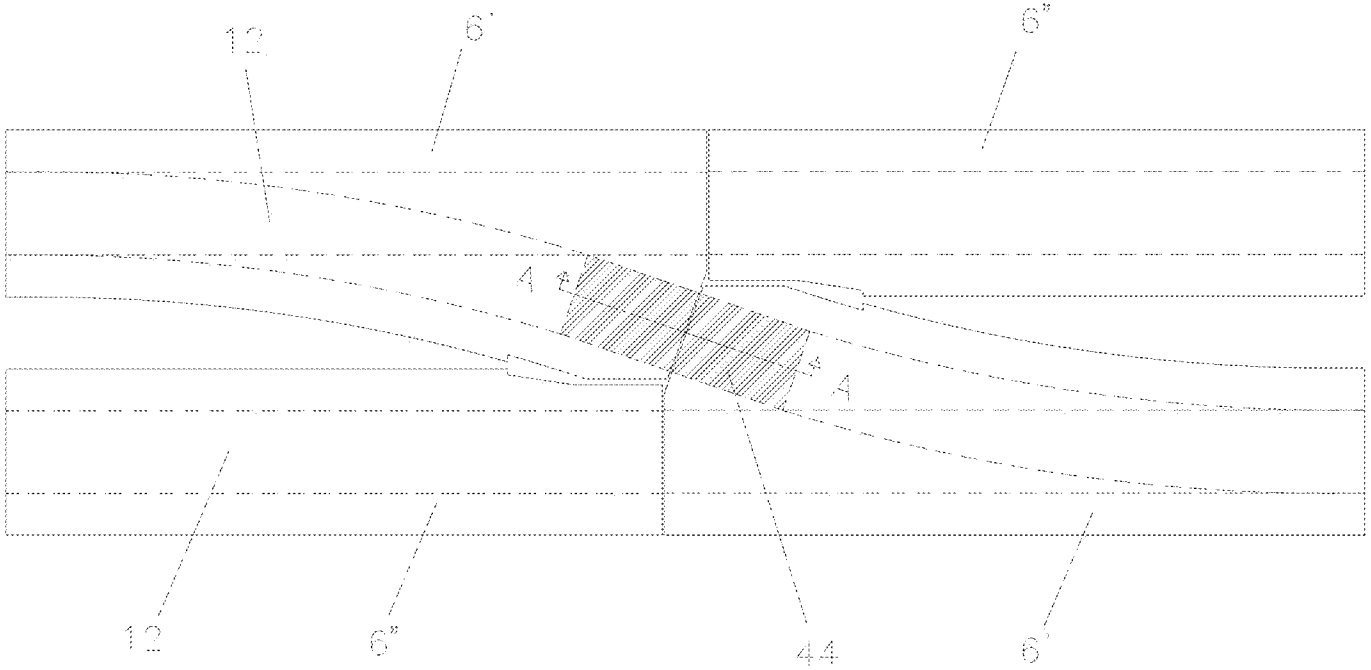

FIGS. 19 and 20 illustrate the section isolation valve prominently and in the closed and open positions, respectively. FIGS. 21 and 22 illustrate the section isolation valve mounted on the rail (6) and respectively in the closed and open positions. In the closed position the airflow is obstructed inside the propulsion duct (12) by the presence of the shutter (40). A linear actuator (41), preferably pneumatic, activates a set of two articulated rods (42) until the position of the stop limit (43). In this manner, based on the same principle of the crossbeam, the angle formed between the articulated structures (42) characterizes the valve as being "monostable" remaining in safe closed position, even in the absence of pneumatic pressure in the linear actuator (41) or in the improbable collapse of its rod. There also exists a positive locking with safety pin, positioned on the base of the lower articulated rod (42), which counts on two orifices each, to guarantee the locking both in the open or closed position, even if the linear actuator (41) is erroneously commanded to move.

FIG. 23 indicates the hold position (44) for coupling of the section isolation valve inside the junction of the propulsion ducts (12) of the two turnout beams (6') which form the crossbeam.

The invention claimed is:

1. A track changing device for a pneumatic transport vehicle comprising:

a track-changing device for use with a two-way pneumatic propulsion system which vehicles (1) travel over railway tracks (5) laid over an elevated track (6) supported by pillars (7), having in a center of a top portion of a superstructure of the elevated track (6) a longitudinal slot (9) with a seal (8) wherein a mast (3) of a propulsion plate (4) is able to move freely along a path, and wherein the track-changing device comprising four beams which constitute a superstructure of the elevated track, being two turnout beams (6') and two straight beams (6"), whereby the four beams are permanently connected to each other and to the pillars (7) to form a monolithic hyperstatic structure, being fixed on the superstructure of turnout beams (6') mobile rails (16, 18 and 21) and respective drive mechanisms (17, 19 and 20) and locking mechanisms (15), and having a section isolation valve inside a propulsion duct (12) of the turnout beams (6'); a sealing terminal (14) of the longitudinal slot (9) of the turnout beam (6') which is executed in flexible material and fixed on a complementary metallic part (13), in an opposite direction to a track bifurcation, which enables a derivation from a single seal (8) of a slot of the longitudinal duct (9) on the straight beam (6") to a second sealing of a propulsion duct (12) on the turnout beam (6'); and wherein the said sealing terminal (14) being in one piece which proximal end presents only two "V" shaped profiles laid down which are opposite and separate (14*a*), with an intermediary part comprising a vertical membrane (14*b*) which begins a bifurcation of sealing tabs of each slot of the turnout beam (6') and a distal end having a horizontal membrane (14*c*) which interconnects two sets of pairs of sealing tabs for two slots of the turnout beam (6'), whereby in the sealing terminal's distal end there is continuity to the common shape of the seal (8) profile by an in loco seam.

2. The device according to claim 1, wherein said turnout beams (6') comprise a lower slab, lateral walls and part of an upper slab are concrete, the latter comprising a complementary metallic part (13) connected in balance, to allow an unobstructed passage of the propulsion plate (4) of the vehicle (1) inside the propulsion duct (12) during a track-change maneuver.

3. The device according to claim 1, wherein a mobile track comprises a pivoting track to be individually moved as gates (16) and frog (21) and intermediary rails (18) which are directly connected.

4. The device according to claim 3, wherein the drive mechanism (17 and 20) of the gates (16) and frogs (21) being comprised of a single base (23) over which lies a linear actuator (24) which displaces two articulation bars in a central point thereof, being a primary articulation bar (25)

connected to a course regulator (26) and a secondary articulation bar (27) being directly coupled on a mobile rail (16 or 21) for conduction thereof.

5. The device according to claim 3, wherein drive mechanism (19) intermediary mobile tracks (18) comprise a linear actuator (29) which activates a lever (30) consequently spinning an eccentric (31) which in turn, simultaneously moves both an articulation bar (32) connected to the mobile tracks (18) to be aligned for tangent passage, as well as another articulation bar (33) connected to the mobile tracks (18) to be aligned for reverse passage, by two limit stops (34) to ensure maintenance of the position of a respective alignment, whereby a support is provided against one of a face of an end that is opposite to the lever (30).

6. The device according to claim 3, wherein the locking mechanism (15) of mobile rails (16, 18 and 21), comprise a support base (35) coupled to a fixed track and on which a linear actuator (36), a sliding lock (37) and the position sensors (38) are fixed, whereby a lock fitting (39) is coupled to the mobile rail (16, 18 or 21) which can comprise one or two recesses.

7. The device according to claim 1, wherein the section isolation valve being mounted on the track (6) comprises a shutter (40) and a linear actuator (41) which activates a set of two articulated rods (42) to the position of a limit stop (43).

* * * * *